US005713628A

United States Patent [19]

Lucatuorto

[11] Patent Number: 5,713,628

[45] Date of Patent: Feb. 3, 1998

[54] STADIUM SEAT TRAY

[76] Inventor: Pasquale Lucatuorto, 6620 Stonehedge Ct., Loomis, Calif. 95650

[21] Appl. No.: 645,553

[22] Filed: May 13, 1996

[51] Int. Cl.[6] ..... A47C 7/62

[52] U.S. Cl. ..... 297/188.06; 297/188.05

[58] Field of Search ..... 297/188.04, 188.05, 297/188.06, 254, 256.11, 256.15; 108/47, 135

[56] References Cited

U.S. PATENT DOCUMENTS

| | | | |
|---|---|---|---|
| 2,255,973 | 9/1941 | Hoobler | 297/188.05 X |
| 2,263,863 | 11/1941 | Wolfe | 297/188.05 X |
| 2,267,861 | 12/1941 | Haley | 297/188.06 X |
| 2,508,688 | 5/1950 | Rossi | 297/254 |
| 2,680,523 | 6/1954 | Heeter | 108/47 X |
| 3,044,828 | 7/1962 | Fowler | 297/188.06 |
| 3,563,600 | 2/1971 | Converse | 297/254 |
| 3,690,525 | 9/1972 | Koons | 297/254 X |
| 5,031,960 | 7/1991 | Day | 297/256.11 X |
| 5,148,755 | 9/1992 | Morales | 108/47 |
| 5,356,061 | 10/1994 | Yu | 297/188.06 X |
| 5,570,642 | 11/1996 | Lehrman | 108/47 |

*Primary Examiner*—Peter M. Cuomo
*Assistant Examiner*—David E. Allred

[57] ABSTRACT

A tray for supporting food and beverages relative to a back of a seat. The inventive device includes a support assembly positionable over sides of a seat and against a seat back. An upper tray is secured to the support assembly and includes lateral cup holders to support beverages and food upon the tray. A lower tray can be provided and secured to the support assembly beneath the upper tray so as to support additional food and beverages relative to the seat back.

7 Claims, 3 Drawing Sheets

STADIUM SEAT TRAY

BACKGROUND OF THE INVENTION

1. Field of the Invention

The present invention relates to supporting devices and more particularly pertains to a stadium seat tray for supporting food and beverages relative to a back of a seat.

2. Description of the Prior Art

The use of supporting devices is known in the prior art. More specifically, supporting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art supporting devices include U.S. Pat. Nos. 4,262,962; 5,140,914; 4,906,043; 4,715,652; DE 273,926; and DE 272,402.

While these devices fulfill their respective, particular objectives and requirements, the aforementioned patents do not disclose a stadium seat tray for supporting food and beverages relative to a back of a seat which includes a support assembly positionable over an upper edge of a seat back, an upper tray secured to the support assembly and including a lateral cup holders, and a lower tray Secured to the support assembly beneath the upper tray so as to support additional food and beverages relative to the seat back.

In these respects, the stadium seat tray according to the present invention substantially departs from the conventional concepts and designs of the prior art, and in so doing provides an apparatus primarily developed for the purpose of supporting food and beverages relative to a back of a seat.

SUMMARY OF THE INVENTION

In view of the foregoing disadvantages inherent in the known types of supporting devices now present in the prior art, the present invention provides a new stadium seat tray construction wherein the same can be utilized for supporting food and beverages relative to a back of a seat. As such, the general purpose of the present invention, which will be described subsequently in greater detail, is to provide a new stadium seat tray apparatus and method which has many of the advantages of the supporting devices mentioned heretofore and many novel features that result in a stadium seat tray which is not anticipated, rendered obvious, suggested, or even implied by any of the prior art supporting devices, either alone or in any combination thereof.

To attain this, the present invention generally comprises a tray for supporting food and beverages relative to a back of a seat. The inventive device includes a support assembly positionable over the sides of a seat and against a seat back. An upper tray is secured to the support assembly and includes lateral cup holders to support beverages and food upon the tray. A lower tray can be provided and secured to the support assembly beneath the upper tray so as to support additional food and beverages relative to the seat back.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new stadium seat tray apparatus and method which has many of the advantages of the supporting devices mentioned heretofore and many novel features that result in a stadium seat tray which is not anticipated, rendered obvious, suggested, or even implied by any of the prior art tool guides, either alone or in any combination thereof.

It is another object of the present invention to provide a new stadium seat tray which may be easily and efficiently manufactured and marketed.

It is a further object of the present invention to provide a new stadium seat tray which is of a durable and reliable construction.

An even further object of the present invention is to provide a new stadium seat tray which is susceptible of a low cost of manufacture with regard to both materials and labor, and which accordingly is then susceptible of low prices of sale to the consuming public, thereby making such stadium seat trays economically available to the buying public.

Still yet another object of the present invention is to provide a new stadium seat tray which provides in the apparatuses and methods of the prior art some of the advantages thereof, while simultaneously overcoming some of the disadvantages normally associated therewith.

Still another object of the present invention is to provide a new stadium seat tray for supporting food and beverages relative to a back of a seat.

Yet another object of the present invention is to provide a new stadium seat tray which includes a support assembly positionable over the sides of a seat and against a seat back, an upper tray secured to the support assembly and including a lateral cup holders, and a lower tray secured to the support assembly beneath the upper tray so as to support additional food and beverages relative to the seat back.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
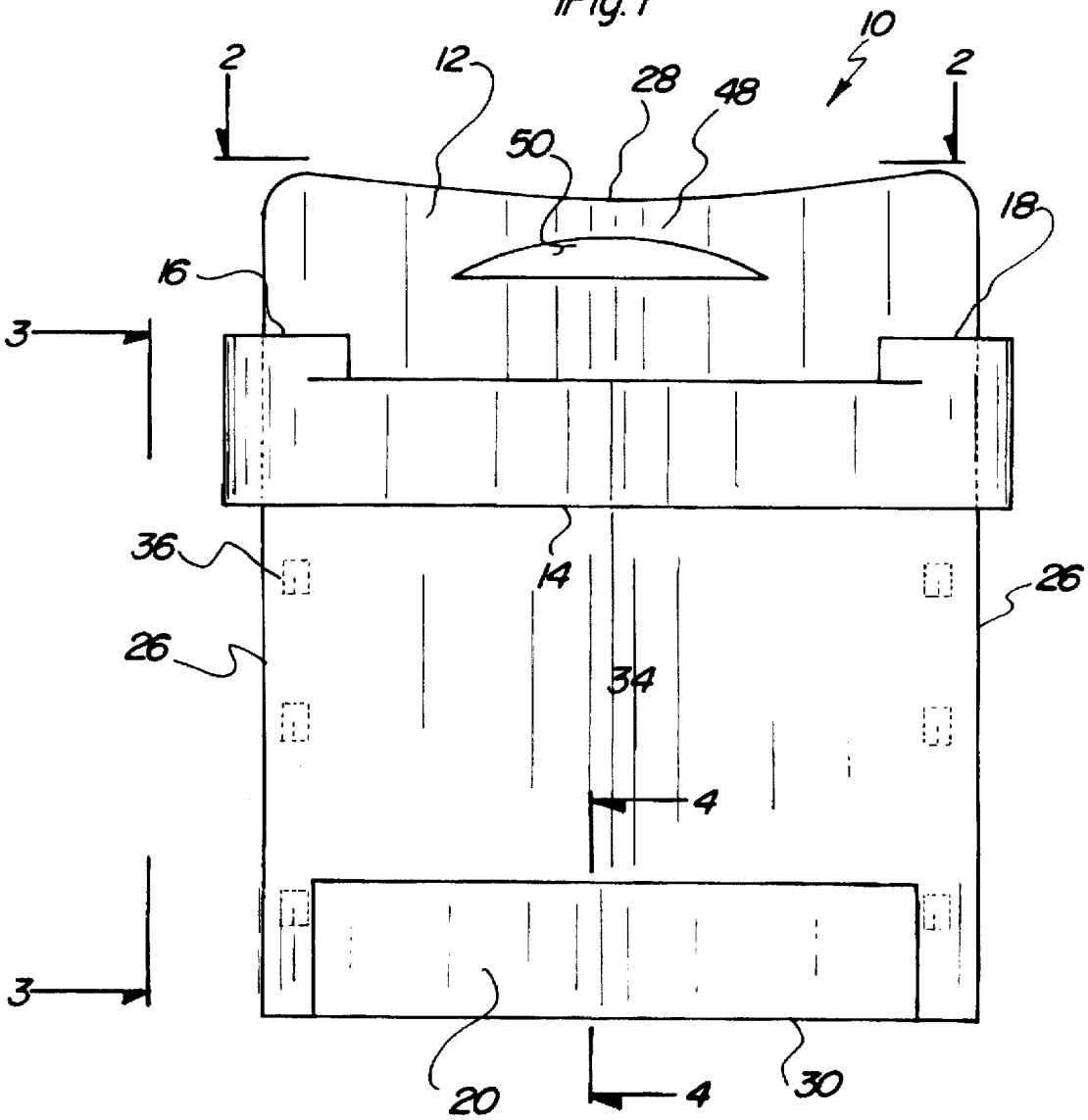
FIG. 1 is a front elevation view of a stadium seat tray according to the present invention.

With reference now to the drawings, and in particular to FIGS. 1–6 thereof, a stadium seat tray embodying the principles and concepts of the present invention and generally designated by the reference numeral 10 will be described.

More specifically, it will be noted that the stadium seat tray 10 comprises a support panel 12 for securing to a seat back of an unillustrated stadium seat or other similar structure. An upper tray 14 is fixedly secured to the support panel 12 and includes a first upper lateral cup holder 16 positioned at a first end thereof, and a second upper lateral cup holder 18 positioned at a second end thereof, as best illustrated in FIG. 1 of the drawings. A lower tray 20 can be provided with the present invention 10 and secured beneath the upper tray 14 to the support panel 12. By this structure, a plurality of food and beverages can be removably positioned within the upper tray 14 and the lower tray 20 as desired so as to be supported relative to a back of a stadium seat.

Figure 6:
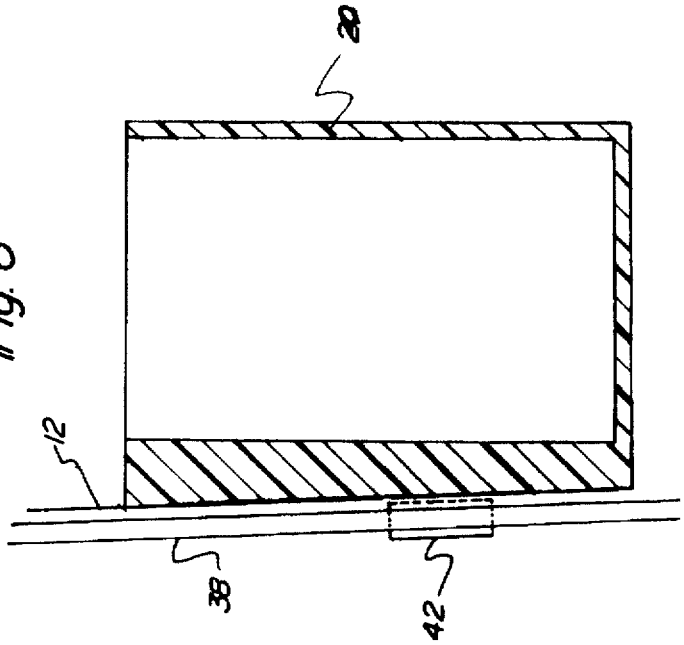
FIG. 6 is a cross sectional view taken along line 6—6 of FIG. 5.
Figure 5:
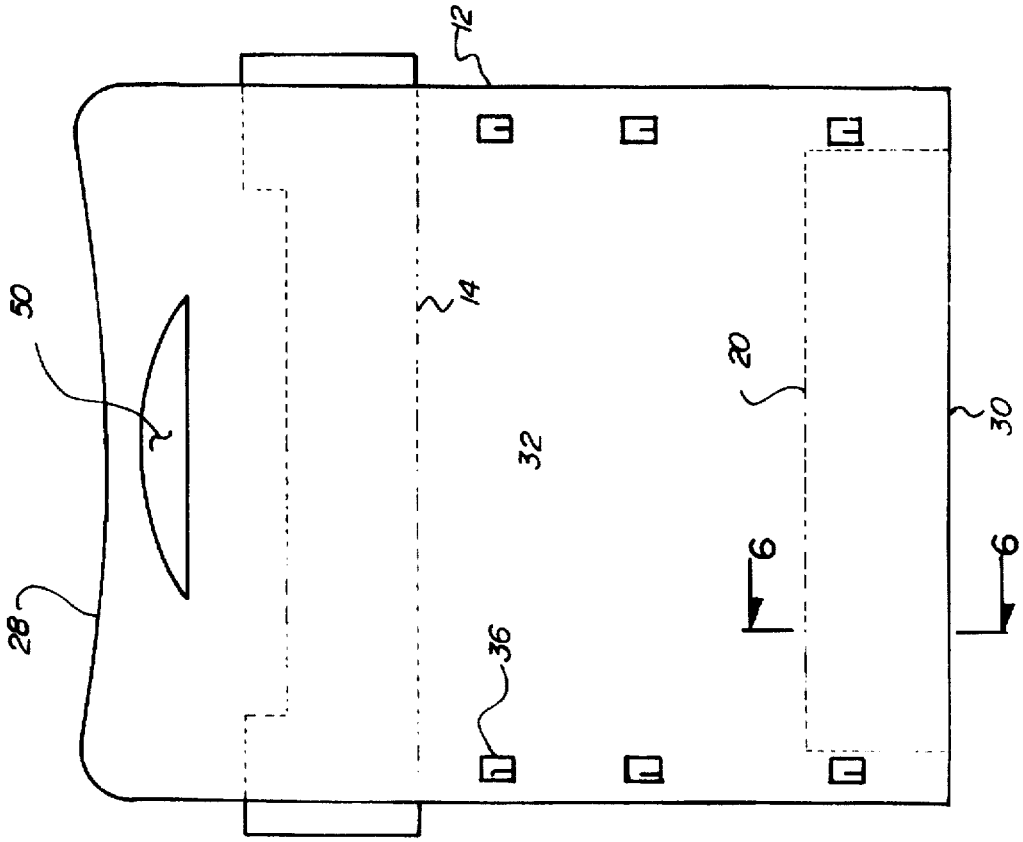
FIG. 5 is a rear elevation view of the invention.

As best illustrated in FIGS. 1, it can be shown that the support panel 12 according to the present invention 10 preferably comprises pair of vertical side edges 26 and a pair of horizontal edges 28 and 30. The horizontal edges form a top edge 28 and a bottom edge 30. The support panel has a front side 32 and a back side 34. FIG. 5 shows the front side of the support panel has a plurality of slots 36 positioned through the front side. Each slot is proportionately spaced from another slot with the plurality of slots forming two columns of three slots. Each column of three slots is adjacent each vertical side edge. FIG. 6 shows the support panel with the lower tray and the tab positioned in the slot behind the lower tray.

Figure 3:
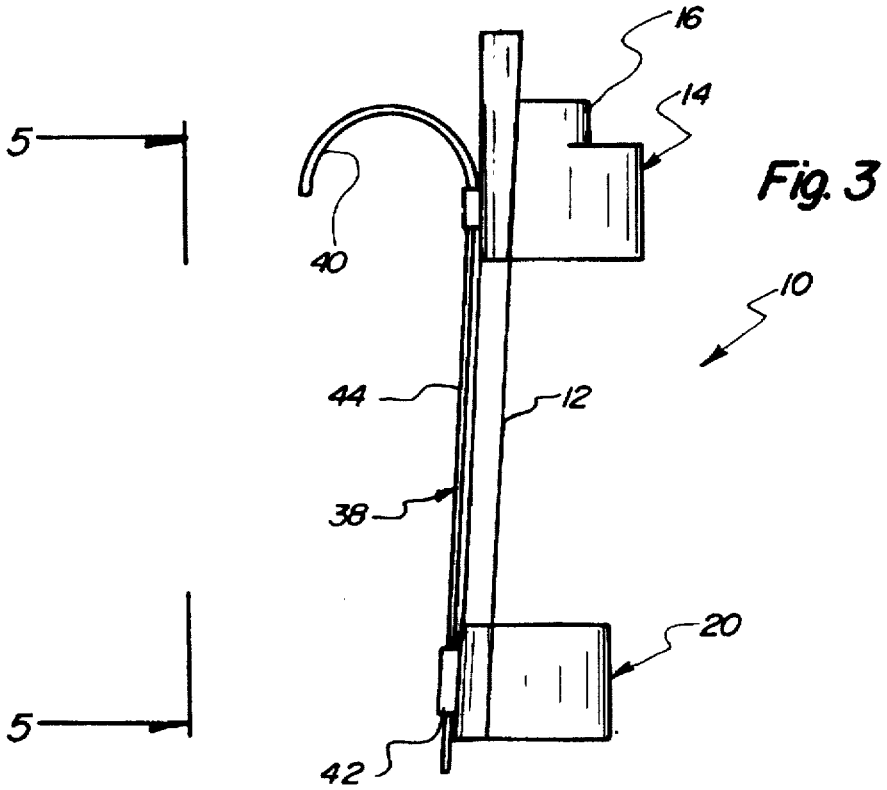
FIG. 3 is a side elevation view of the present invention taken from line 3—3 of FIG. 1.

Included are a pair of hook members 38, as shown in FIG. 3. Each hook member has an upper end with a hooked end 40 that extends from the upper end thereof. The hook members have a lower end with a tab 42 extending from the lower end. The hook members have middle portions 44. Each hook member is selectively positioned. The tab fits into a slot on the back of the support panel. The pair of hook members are positioned over a side of the seat such that the hook members extend along a back side of the seat back and are downwardly oriented. Each hook member is substantially in a parallel configuration with a respective side of the panel. The panel 12 is adjustably coupled to the hooked members.

Figure 2:
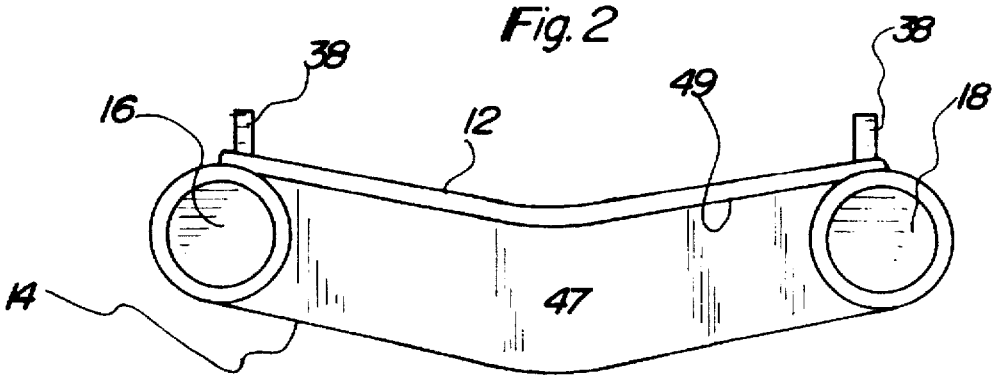
FIG. 2 is a top plan view thereof taken from line 2—2 of FIG. 1.
Figure 4:
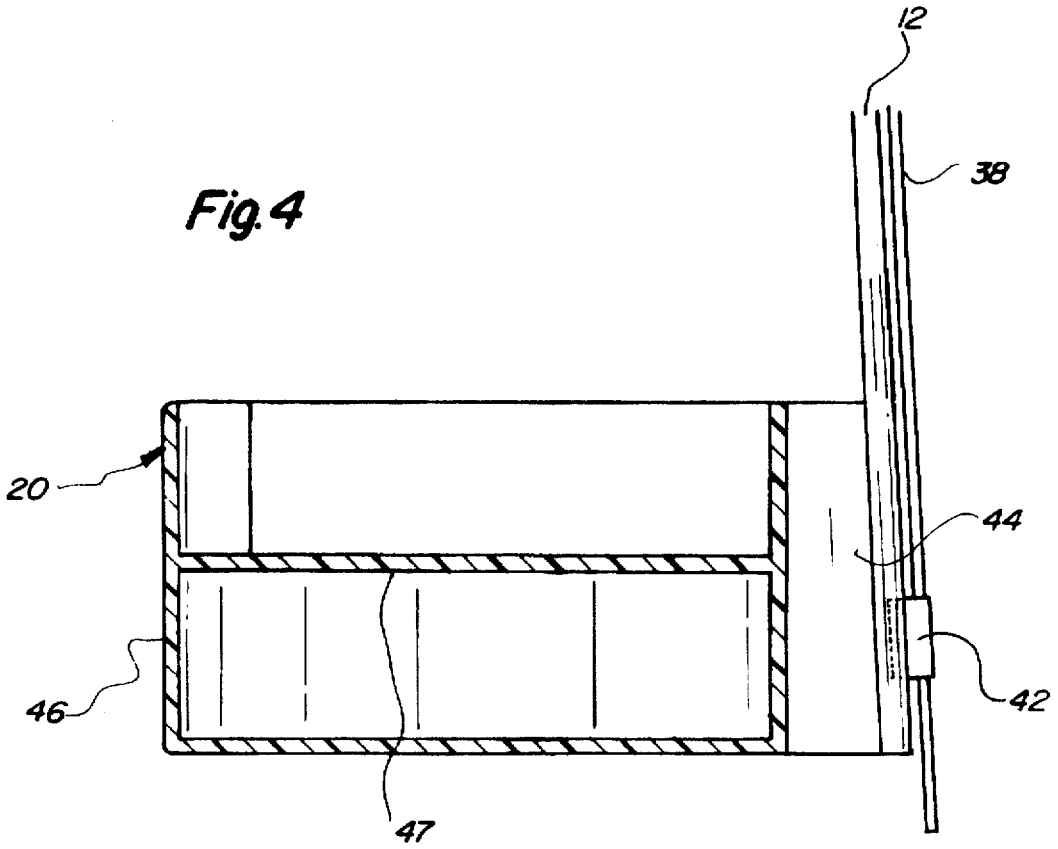
FIG. 4 is a cross sectional view taken along line 4—4 of FIG. 1.

As best illustrated in FIGS. 2 and 4, it can be shown that each of the trays 14 and 20 comprises an inner arcuate side wall 45 which extends in a substantially spaced and parallel orientation relative to an outer arcuate side wall 46. A tray floor 47 extends substantially orthogonally between the inner arcuate side wall 44 and the outer arcuate side wall 46 to permit placement of food items or the like thereon for support at a desired orientation relative to the back of an associated seat. The inner arcuate side wall 44 thus operates to conform to an exterior shape of the support panel 12 when the panel is positioned against a typical back of a stadium seat so as to position the tray closely relative thereto.

As best illustrated in FIGS. 1 and 5, it can be shown that the present invention 10 may further comprise a handle 48 formed within the support panel 12 and spaced from the upper tray 14 permitting manual transportation of the device 10 as desired. To this end, the handle 48 preferably is spaced above the inner arcuate side wall of the upper tray and directed through the front 32 and back 34 side of the support panel to define a handle aperture 50 for permitting a passage of digits of a human hand during grasping of the handle 48.

In use, the stadium seat tray 10 according to the present invention can be easily utilized for supporting food and beverages relative to a back of a seat. The present invention 10, because of the hooked member 38 attached thereto, permits the upper tray 14 and the lower tray 20 attached to the support panel to be adjustably positioned into a desired orientation relative to the seat as well as to facilitate customizing of the configuration of the device 10 to a particular stadium seat.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A stadium seat tray comprising:

a support panel for securing to a seat back of a seat, the support panel having a pair of vertical side edges and a pair of horizontal edges therebetween, the horizontal edges forming a top edge and a bottom edge, the support panel having a front side and a back side, the front side of the support panel having a plurality of slots therethrough, each of said slots being proportionately spaced from another of said slots with the plurality of slots forming two columns of three slots with each column being adjacent each of said pair of vertical side edges;

an upper tray fixedly secured to the support panel and including a first upper lateral cup holder positioned at a first end thereof, and a second upper lateral cup holder positioned at a second end thereof;

a lower tray fixedly secured to the support panel beneath the upper tray;

each of the trays having an inner arcuate side wall; an outer arcuate side wall extending in a substantially spaced and parallel orientation relative to a respective inner arcuate side wall; a tray floor extending substantially orthogonally between the inner arcuate side wall and the outer arcuate side wall; and pair of hook members with each of the hook members having a hooked end extending from a upper end thereof; a tab extending from a lower end thereof and a middle portion, each of the hook members can be selectively positioned; and the tab fits into one of said slots on the front of the support panel, the pair of hook members being positioned over a side of the seat such that the hook members extend along a back side of the seat back with the pair of hook members in a downwardly oriented and substantially parallel configuration, the panel being adjustably coupled to the hook members.

2. The stadium seat tray of claim 1 and further comprising a handle integral with the support panel and spaced from the top edge of an upper portion of the support panel.

3. The stadium seat tray of claim 2, wherein the handle being spaced above the inner arcuate side wall of the upper tray and directed through the front and back side of the support panel for permitting a passage of digits of a human hand during grasping of the handle.

4. A stadium seat tray for coupling with a seat comprising:

a support panel being sized for securing to the seat back of the seat, the support panel having a radius of curvature substantially equal to a radius of curvature of the back of the seat the support panel having a pair of vertical side edges and a pair of horizontal edges therebetween, the horizontal edges forming a top edge and a bottom edge, the support panel having a front side and a back side, the front side of the support panel having a plurality of slots therethrough, each of said slots being proportionately spaced from another of said slots with the plurality of slots forming two columns of three slots with each column being adjacent each of said pair of vertical side edges;

an upper tray secured to the support panel and including a first upper lateral cup holder positioned at a first end thereof, and a second upper lateral cup holder positioned at a second end thereof, the upper tray comprising an inner arcuate side wall positioned into an abutting relationship relative to the support panel, the inner arcuate side wall having a radius of curvature substantially equal to a radius of curvature of the support panel; an outer arcuate side wall extending in a substantially spaced and parallel orientation relative to the inner arcuate side wall; a tray floor extending orthogonally between the inner arcuate side wall and the outer arcuate side wall; and a lower tray secured to the support panel beneath the upper tray, the lower tray comprising an inner arcuate side wall positioned into an abutting relationship relative to the support panel, the inner arcuate side wall having a radius of curvature substantially equal to a radius of curvature of the back of the seat; an outer arcuate side wall extending in a substantially spaced and parallel orientation relative to the inner arcuate side wall; a tray floor extending substantially orthogonally between the inner arcuate side wall and the outer arcuate side wall of the lower tray.

5. The stadium seat tray of claim 4, and further comprising a pair of hook members with each of the hook members having a hooked end extending from a upper end thereof; a tab extending from a lower end thereof and a middle portion, each of the hook members can be selectively positioned and the tab fits into one of said slots on the front of the support panel, the pair of hook member being positioned over a side of the seat such that the hook members extend along a back side of the seat back with the pair of hook members in a downwardly oriented and substantially parallel configuration, the panel being adjustably coupled to the hook members.

6. The stadium seat tray of claim 5, and further comprising a handle integral with the support panel and spaced from the top edge of an upper portion of the support panel.

7. The stadium seat tray of claim 6, wherein the handle being spaced above the inner arcuate side wall of the upper tray and directed through the front and back side of the support panel for permitting a passage of digits of a human hand during grasping of the handle.

* * * * *